US006975070B2

(12) United States Patent
Namba et al.

(10) Patent No.: US 6,975,070 B2
(45) Date of Patent: Dec. 13, 2005

(54) POWER SOURCE APPARATUS AND VEHICULAR LAMP

(75) Inventors: Takanori Namba, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/051,192

(22) Filed: Feb. 4, 2005

(65) Prior Publication Data

US 2005/0189822 A1 Sep. 1, 2005

(30) Foreign Application Priority Data

Feb. 9, 2004 (JP) ..... 2004-032635

(51) Int. Cl.[7] ..... B60Q 1/00; H05B 37/02

(52) U.S. Cl. ..... 315/77; 315/76; 315/219; 315/209 R; 315/312

(58) Field of Search ..... 315/77

(56) References Cited

U.S. PATENT DOCUMENTS

| | | | | |
|---|---|---|---|---|
| 5,438,499 | A * | 8/1995 | Bonte et al. | 363/21.16 |
| 6,847,169 | B2 * | 1/2005 | Ito et al. | 315/77 |
| 6,867,557 | B2 * | 3/2005 | Ito et al. | 315/307 |
| 2004/0183476 | A1 * | 9/2004 | Ishizuka | 315/291 |

FOREIGN PATENT DOCUMENTS

| | | |
|---|---|---|
| JP | JP-2002-231013 | 8/2002 |

OTHER PUBLICATIONS

Patent Abstracts of Japan, Publication No. 2002-231013 dated Aug. 16, 2002, 1 page.

* cited by examiner

*Primary Examiner*—Trinh Vo Dinh
(74) *Attorney, Agent, or Firm*—Osha•Liang LLP

(57) ABSTRACT

There is provided a vehicular lamp at low cost. A power source apparatus includes: an output controlling switch operable to intermittently carry an electric current; an output coil operable to accumulate energy according to the current flowing into the output controlling switch and to output an electric power based on the accumulated energy when the output controlling switch is turned off; an end detecting unit operable to detect that the output coil ends the output of the power; and an output controlling unit, in which the output controlling unit includes: a time memorizing unit that memorizes OFF time for which the output controlling switch should be kept off; a switch controlling unit that switches the output controlling switch on and off based on the OFF time memorized in the time memorizing unit; and a time changing unit that changes the OFF time memorized in the time memorizing unit. The time changing unit increases the OFF time when the end detecting unit is not detecting the end of the output and decreases the OFF time when the end detecting unit is detecting the end of the output, in the timing when the output controlling switch is turned on.

4 Claims, 5 Drawing Sheets

POWER SOURCE APPARATUS AND VEHICULAR LAMP

This patent application claims priority from a Japanese Patent Application No. 2004-032635 filed on Feb. 9, 2004, the contents of which are incorporated herein by reference.

BACKGROUND OF THE INVENTION

1. Field of the Invention

The present invention relates to a power source apparatus and a vehicular lamp.

2. Description of Related Art

Conventionally, a vehicular lamp that uses a light-emitting diode element is known as disclosed, for example, in Japanese Patent Laid-Open No. 2002-231013. Alight-emitting diode element for a vehicular lamp emits light according to electric power received from, e.g. a switching regulator.

The switching regulator emits electric power energy in synchronization with the timing in which a switching element switches. In this case, it is preferable that the switching element is controlled based on the end of energy emission, in some cases. However, there was conventionally a problem that a cost of a vehicular lamp increases due to a cost of circuitry for detecting the end of energy emission.

SUMMARY OF THE INVENTION

Therefore, it is an object of the present invention to provide a power source apparatus and a vehicular lamp that can solve the foregoing problems. The above and other objects can be achieved by combinations described in the independent claims. The dependent claims define further advantageous and exemplary combinations of the present invention.

According to the first aspect of the present invention, there is provided a power source apparatus. The power source apparatus includes: an output controlling switch operable to intermittently carry an electric current by repeating on and off; an output coil operable to accumulate energy according to the current flowing into the output controlling switch when the output controlling switch is turned on and to output an electric power based on the accumulated energy when the output controlling switch is turned off; an end detecting unit operable to detect that the output coil ends the output of the power; and an output controlling unit operable to switch the output controlling switch on and off, in which the output controlling unit includes: a time memorizing unit that memorizes OFF time for which the output controlling switch should be kept off; a switch controlling unit that switches the output controlling switch on and off based on the OFF time memorized in the time memorizing unit; and a time changing unit that changes the OFF time memorized in the time memorizing unit, in which the time changing unit increases the OFF time when the end detecting unit is not detecting the end of the output and decreases the OFF time when the end detecting unit is detecting the end of the output, in the timing when the output controlling switch is turned on.

The power source apparatus may sequentially supply electric power to each of a plurality of loads connected in parallel, the time memorizing unit may memorize the plurality of OFF time in association with each of the plurality of loads, the output controlling unit may further include a selection controlling unit that sequentially selects each of the plurality of loads, the switch controlling unit may switch the output controlling switch on and off based on the OFF time corresponding to the load selected by the selection controlling unit, the output coil may supply electric power to the load selected by the selection controlling unit, and the time changing unit may change the OFF time corresponding to the load selected by the selection controlling unit.

The time memorizing unit may be a counter that memorizes numerical value corresponding to the OFF time, the time changing unit may change the numerical value memorized in the time memorizing unit by a predetermined first modification value when the end detecting unit is not detecting the end of the output in the timing when the output controlling switch is turned on, and the time changing unit may change the numerical value memorized in the time memorizing unit by a predetermined second modification value in the opposite direction from what is not detecting the end of the output when the end detecting unit is detecting the end of the output in the timing when the output controlling switch is turned on.

According to the second aspect of the present invention, there is provided a vehicular lamp used for a vehicle. The vehicular lamp includes: a light source unit emitting light; and a power source unit supplying electric power to the light source unit, in which the power source unit includes: an output controlling switch that intermittently carries an electric current by repeating on and off; an output coil that accumulates energy according to the current flowing into the output controlling switch when the output controlling switch is turned on and outputs an electric power based on the accumulated energy when the output controlling switch is turned off; an end detecting unit that detects that the output coil ends the output of the power; and an output controlling unit that is made up of a microcomputer in at least a part thereof and switches the output controlling switch on and off, and the output controlling unit includes: a time memorizing unit that memorizes OFF time for which the output controlling switch should be kept off; a switch controlling unit that switches the output controlling switch on and off based on the OFF time memorized in the time memorizing unit; and a time changing unit that changes the OFF time memorized in the time memorizing unit, in which the time changing unit increases the OFF time when the end detecting unit is not detecting the end of the output and decreases the OFF time when the end detecting unit is detecting the end of the output, in the timing when the output controlling switch is turned on.

The summary of the invention does not necessarily describe all necessary features of the present invention. The present invention may also be a sub-combination of the features described above.

BRIEF DESCRIPTION OF THE DRAWINGS

The above and other objects and features and advantages of the present invention will become more apparent from the following description of the presently preferred exemplary embodiments of the invention taken in conjunction with the accompanying drawings, in which.

DETAILED DESCRIPTION OF THE INVENTION

The invention will now be described based on the preferred embodiments, which do not intend to limit the scope of the present invention, but exemplify the invention. All of the features and the combinations thereof described in the embodiment are not necessarily essential to the invention.

Figure 1:
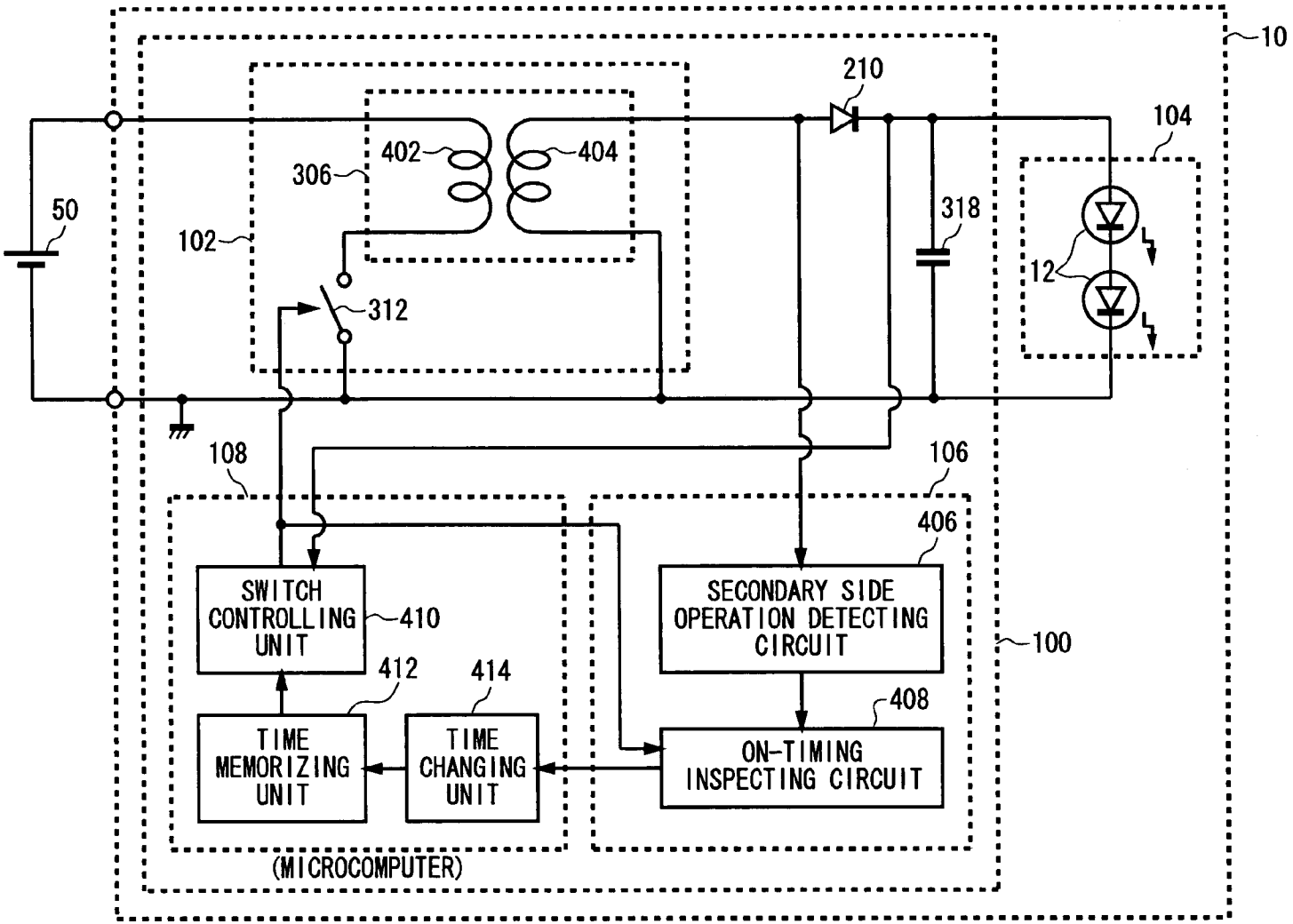
FIG. 1 is a diagram exemplary showing a configuration of a vehicular lamp according to an embodiment of the present invention.

FIG. 1 is a diagram exemplary showing a configuration of a vehicular lamp 10 according to an embodiment of the present invention along with a reference voltage power source 50. The reference voltage power source 50 is, e.g., a battery in a vehicle and supplies a predetermined DC voltage to the vehicular lamp 10. In this example, the vehicular lamp 10 includes a light source unit 104 and a power source unit 100. In the vehicular lamp 10 of the present example, it is an object to adequately control a switching regulator 102 of the power source unit 100 at low cost.

The light source unit 104 includes one or more light-emitting diode element 12. The light-emitting diode element 12 is an example of a semiconductor light-emitting element and emits light according to electric power received from the power source unit 100. Additionally, in another example, the vehicular lamp 10 may include a plurality of light source units 104 connected in parallel.

The power source unit 100 includes a switching regulator 102, a diode 210, a condenser 318, an end detecting unit 106, and an output controlling unit 108. The switching regulator 102 includes an output controlling switch 312 and a transformer 306.

The output controlling switch 312 is connected with a primary coil 402 of the transformer 306 in series, and intermittently carries an electric current by repeating on and off according to the control of the output controlling unit 108. In this way, the output controlling switch 312 intermittently changes the current flowing into the primary coil 402.

The transformer 306 has the primary coil 402 and a secondary coil 404. When the output controlling switch 312 is turned on, the primary coil 402 streams the current received from the reference voltage power source 50. The secondary coil 404 is an example of an output coil, and supplies electric power according to the current flowing into the primary coil 402 to the light source unit 104 via the diode 210. In this example, the secondary coil 404 accumulates energy according to the current flowing into the output controlling switch 312 and the primary coil 402 when the output controlling switch 312 is turned on. Meanwhile, the secondary coil 404 outputs electric power based on the accumulated energy when the output controlling switch 312 is turned off. In addition, the diode 210 is a rectification diode that is connected in a forward direction between the secondary coil 404 and the light source unit 104. The current flowing into the light source unit 104 is smoothed by the condenser 318.

The end detecting unit 106 includes a secondary side operation detecting circuit 406 and an on-timing inspecting circuit 408. The secondary side operation detecting circuit 406 identifies whether the emission of energy by the secondary coil 404 was ended based on a voltage of an output terminal of the secondary coil 404. Here, it may be identified whether the emission was ended based on a voltage of a connection point between the output controlling switch 312 and the primary coil 402. In this way, the end detecting unit 106 detects that the secondary coil 404 ends the output of electric power.

The on-timing inspecting circuit 408 receives an identification result by the secondary side operation detecting circuit 406 from the secondary side operation detecting circuit 406, and receives a control signal for the output controlling switch 312 from the output controlling unit 108. This control signal is a signal to switch the output controlling switch 312 on and off.

In addition, the on-timing inspecting circuit 408 detects an identification result in the timing when the output controlling switch 312 is turned on, and supplies the detected result to the output controlling unit 108. In this way, the end detecting unit 106 informs the output controlling unit 108 of an operation mode of the secondary coil 404 in the timing when the output controlling switch 312 is turned on.

In this example, the end detecting unit 106 informs the output controlling unit 108 of whether an operation of the secondary coil 404 is either of a current discontinuous mode or a current continuous mode. Here, a current discontinuous mode is a mode in which the secondary coil 404 ends the output of power, e.g., before the output controlling switch 312 is turned on. In addition, a current continuous mode is a mode in which the secondary coil 404 is not ending the output of power, e.g., in the timing when the output controlling switch 312 is turned on. In this way, the end detecting unit 106 informs the output controlling unit 108 of whether the secondary coil 404 ends the output of electric power.

The output controlling unit 108 is made up of a microcomputer, and includes a time memorizing unit 412, a switch controlling unit 410, and a time changing unit 414. The time memorizing unit 412 memorizes OFF time for which the output controlling switch 312 should be kept off. In this example, the time memorizing unit 412 is a counter that memorizes numerical value corresponding to the OFF time.

The switch controlling unit 410 supplies a control signal based on the OFF time memorized in the time memorizing unit 412 to the output controlling switch 312 to control the output controlling switch 312. In this way, for example, when the output controlling switch 312 is turned off, the switch controlling unit 410 keeps the output controlling switch 312 off for the OFF time. Additionally, in this example, the switch controlling unit 410 computes ON time for which the output controlling switch 312 should be kept on based on an output voltage of the power source unit 100 or the switching regulator 102. In this example, the output controlling switch 312 memorizes numerical value corresponding to the ON time, e.g., with a counter. Then, when turning on the output controlling switch 312 next, the switch controlling unit 410 keeps the output controlling switch 312 on for the computed ON time. In this way, the output controlling unit 108 switches the output controlling switch 312 on and off based on the computed ON time and the OFF time memorized in the time memorizing unit 412.

In addition, in another example, the output controlling unit 108 may compute ON time based on an electric current flowing into the light source unit 104. In this case, the light source unit 104 further has, e.g., a resistor connected with the light source unit 104 in series. Thus, the output controlling unit 108 detects an electric current flowing into the light source unit 104 based on voltage of both ends of this resistor.

The time changing unit 414 changes the OFF time memorized in the time memorizing unit 412 according to information from the end detecting unit 106. For example, when receiving information that an operation of the secondary coil 404 is a current continuous mode from the end detecting unit 106, the time changing unit 414 increases the OFF time. In addition, when receiving information that an operation of the secondary coil 404 is a current discontinuous mode, the time changing unit 414 decreases the OFF time. In this way, when the end detecting unit 106 is not detecting the end of output in the timing when the output controlling switch 312 is turned on, the time changing unit 414 increases the OFF time. Further, when the end detecting unit 106 is detecting the end of output, the time changing unit 414 decreases the OFF time.

Therefore, according to this example, the switching regulator 102 can adequately be operated in a current boundary mode. Here, a current boundary mode is an operation mode in which the output controlling switch 312 is turned on when the secondary coil 404 has completely emitted energy. In this way, the switching regulator 102 can be operated efficiently.

In addition, according to this example, it is possible to adequately control the output controlling switch 312 using the output controlling unit 108 that is made up of a cheap microcomputer, e.g., without a high-speed interrupt handling function. Therefore, according to this example, the vehicular lamp 10 can be offered at low cost.

Additionally, in another example, e.g., a part of the end detecting unit 106 may be made up of a microcomputer along with the output controlling unit 108. For example, a part of the output controlling unit 108 may also be made up of a microcomputer. In these cases, the switching regulator 102 can adequately be operated in a current boundary mode using a cheap microcomputer.

Figure 2:
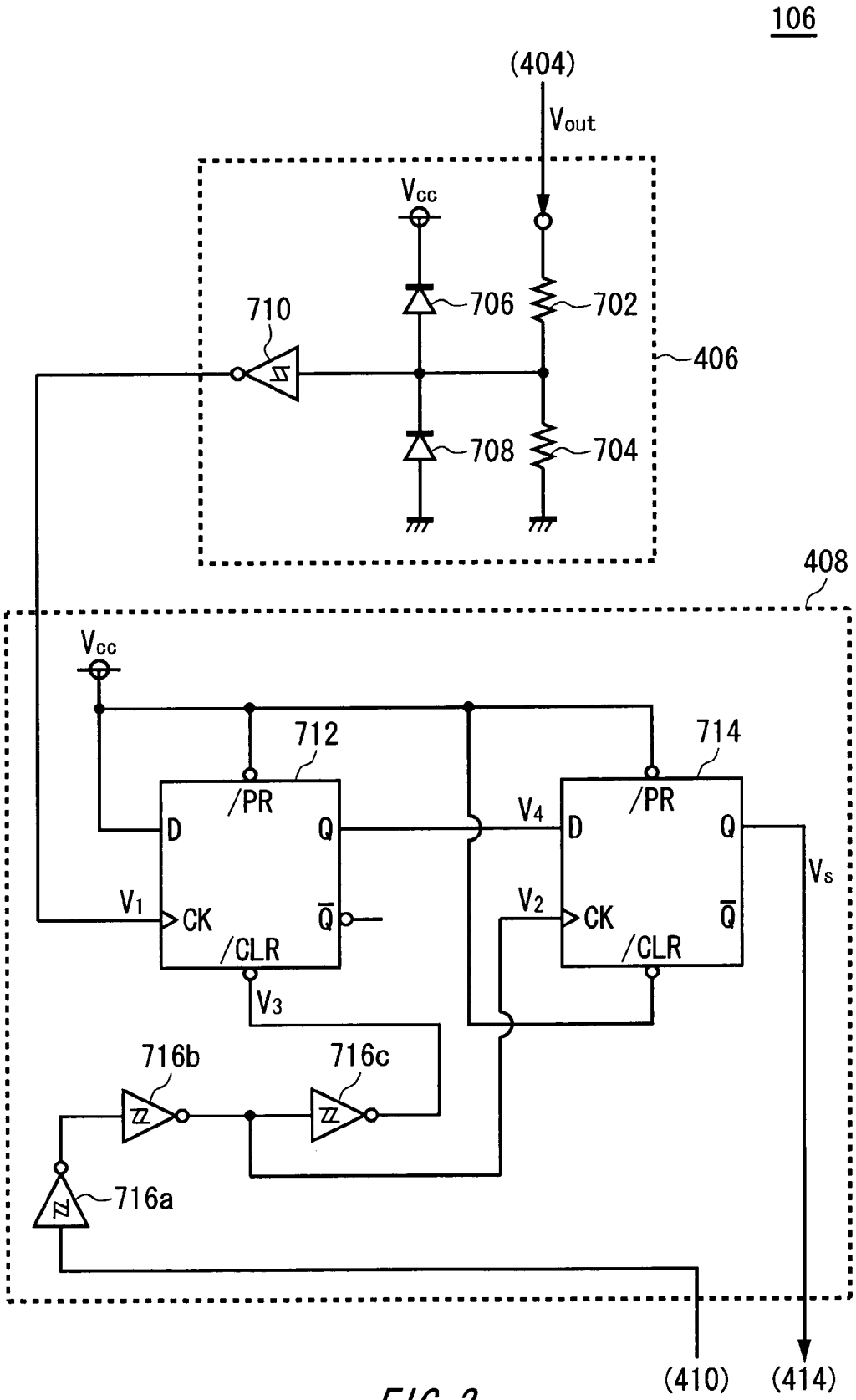
FIG. 2 is a diagram exemplary showing a configuration of an end detecting unit.

FIG. 2 is a diagram exemplary showing a configuration of the end detecting unit 106. In this example, the secondary side operation detecting circuit 406 of the end detecting unit 106 includes a plurality of resistors 702 and 704, a plurality of diodes 706 and 708, and a Schmidt trigger inverter 710.

The plurality of resistors 702 and 704 divides the voltage $V_{out}$ of the output terminal of the secondary coil 404, and supply it to the Schmidt trigger inverter 710. The diode 706 is connected between an input terminal of the Schmidt trigger inverter 710 and a predetermined power source voltage $V_{cc}$ in the reverse direction. In addition, the diode 708 connected between the input terminal of the Schmidt trigger inverter 710 and a predetermined ground potential in the reverse direction. In this way, the plurality of diodes 706 and 708 protects the input terminal of the Schmidt trigger inverter 710.

The Schmidt trigger inverter 710 supplies the comparison result between the plurality of resistors 702 and 704 and a predetermined threshold voltage to the on-timing inspecting circuit 408. In this way, the secondary side operation detecting circuit 406 detects that the secondary coil 404 ends the output of electric power. In this example, when the secondary coil 404 ends the output of electric power, the secondary side operation detecting circuit 406 outputs an H signal to the on-timing inspecting circuit 408 according to voltage reduction of the output terminal of the secondary coil 404. In addition, when the secondary coil 404 is not ending the output of electric power, the secondary side operation detecting circuit 406 outputs an L signal. According to this example, it is possible to detect the end of power output with high precision by using the Schmidt trigger inverter 710 having a low threshold voltage.

The on-timing inspecting circuit 408 includes a plurality of Schmidt trigger inverters 716*a* to 716*c* and a plurality of flip-flops 712 and 714. The plurality of Schmidt trigger inverters 716*a* to 716*c* is serially connected. The Schmidt trigger inverter 716*a* in a first stage receives a control signal for the output controlling switch 312 (see FIG. 1) from the switch controlling unit 410. In this way, the Schmidt trigger inverter 716*b* in a next stage outputs a normal signal $V_2$ of the control signal, and the Schmidt trigger inverter 716*c* in a last stage outputs an inversion signal $V_3$ of the control signal.

The plurality of flip-flops 712 and 714 is D flip-flops. The flip-flop 712 receives an output $V_1$ of the Schmidt trigger inverter 710 through a clock terminal CK and the inversion signal $V_3$ of the control signal through a /CLR terminal (a CLR bar terminal). In addition, a D input terminal and a /PR terminal (a PR bar signal terminal) of the flip-flop 712 receive a power source voltage Vcc. Here, the Schmidt trigger inverters 716*a* to 716*c* may be a mere inverter.

In this case, when an input $V_1$ rises while the inversion signal $V_3$ is H, the flip-flop 712 outputs an H signal. Here, the inversion signal $V_3$ becomes H when the output controlling switch 312 is off. In addition, the input $V_1$ rises when the secondary coil 404 ends the output of electric power. For that purpose, in this example, the flip-flop 712 outputs an H signal when the secondary coil 404 ends the output of electric power while the output controlling switch 312 is in off.

The flip-flop 714 receives the normal signal $V_2$ of the control signal through a clock terminal CK and a Q output $V_4$ of the flip-flop 712 through a D input terminal. A /CLR terminal and /PR terminal of the flip-flop 714 receives the power source voltage $V_{cc}$. In addition, the flip-flop 714 supplies a Q output $V_5$ to the time changing unit 414.

In this case, the flip-flop 712 supplies the Q output $V_4$ of the flip-flop 712 to the time changing unit 414 in response to a rising edge of the normal signal $V_2$. Here, the normal signal $V_2$ becomes H when the output controlling switch 312 is on. Therefore, the flip-flop 714 supplies the Q output $V_4$ of the flip-flop 712 in the timing when the output controlling switch 312 is turned on to the time changing unit 414.

Therefore, when the secondary coil 404 ends the output of electric power while the output controlling switch 312 is in off just before on, the flip-flop 714 outputs an H signal as the Q output $V_5$. In this way, the on-timing inspecting circuit 408 informs the time changing unit 414 of the information that an operation of the switching regulator 102 (see FIG. 1) is a current discontinuous mode. For example, when the voltage of the output terminal of the secondary coil 404 is substantially 0V in the timing when the output controlling switch 312 is turned on, the on-timing inspecting circuit 408 informs the time changing unit 414 of a current discontinuous mode.

In addition, when the secondary coil 404 is not ending the output of electric power while the output controlling switch 312 is in off just before on, the flip-flop 714 outputs an L signal as the Q output $V_5$. In this way, the on-timing inspecting circuit 408 informs the time changing unit 414 of the information that an operation of the switching regulator 102 is a current continuous mode. According to this example, it is possible to detect an operation mode of the switching regulator 102 adequately.

Here, in another example, a voltage of the output terminal of the secondary coil 404 may also be detected by, e.g., an interrupt of a microcomputer. However, in this case, since the vehicular lamp 10 has to perform voltage detection with precision not more than, e.g., about 500 ns, there can be required a high-speed microcomputer not less than, e.g., about 120 MHz in some cases when considering interrupt delay (for example, about 60 clocks in 30 states having two clocks per one state). However, the cost of vehicular lamp 10 increases due to such a high-speed microcomputer.

Additionally, it is conceivable that the output controlling unit 108 (see FIG. 1) is made up of a dedicated PWM (pulse-width modulation) controlling circuit without the use of a microcomputer. However, the PWM controlling circuit is large-scale circuitry because it includes a comparator and an Op-Amp or a dedicated PWMIC. Therefore, in this case, the cost of vehicular lamp 10 also increases.

However, in this example, the end detecting unit 106 detects whether an operation of the secondary coil 404 is a current discontinuous mode or a current continuous mode using the secondary side operation detecting circuit 406 and the on-timing inspecting circuit 408 that can be composed by cheap circuit elements. Then, the output controlling unit 108 changes OFF time in the control signal based on a detection result of the end detecting unit 106. Therefore, according to this example, since a high-speed interrupt is not required, the output control region 108 can be made up of a cheap microcomputer. In this way, it is also possible to provide the vehicular lamp 10 at low cost. Further, the vehicular lamp 10 can be miniaturized by composing the output controlling unit 108 with a microcomputer.

In addition, this microcomputer may be a microcomputer that is used in common with the other control unit in the vehicle. For example, this microcomputer may further control a swivel and an automatic leveling of an Adaptive Frontlighting System. In this way, the number of components in the control unit of the vehicle can be reduced.

Figure 3A:
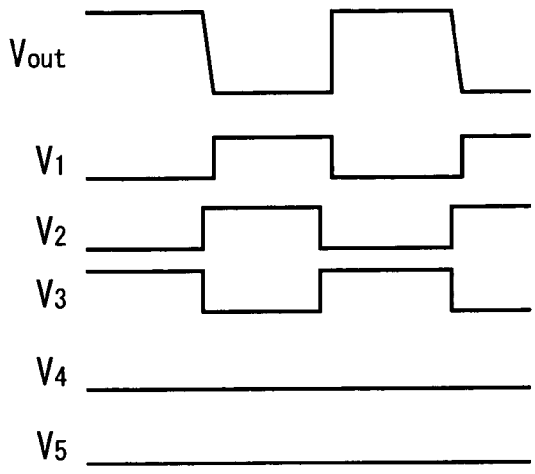
FIGS. 3A to 3C are timing charts exemplary showing an operation of an end detecting unit.
Figure 3B:
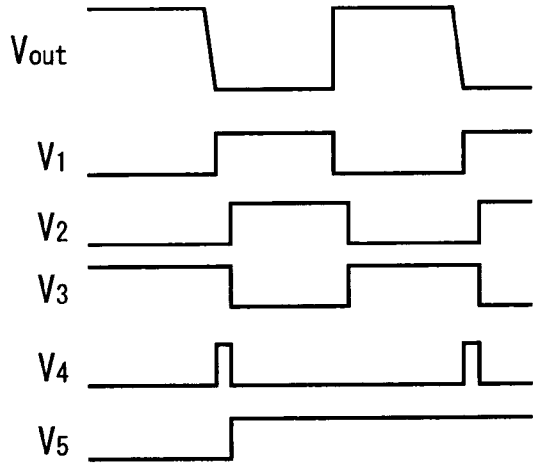
Figure 3C:
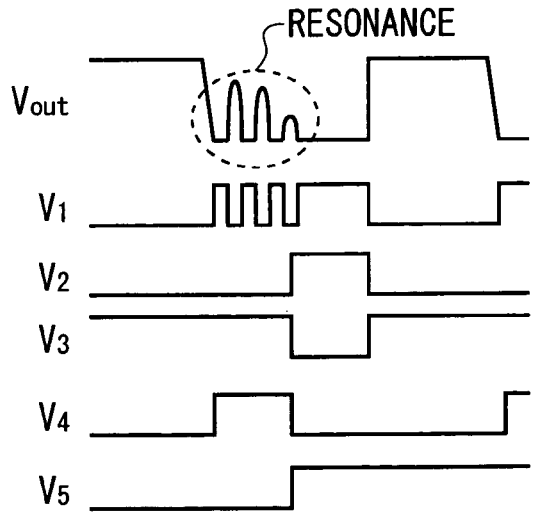

FIGS. 3A to 3C are timing charts exemplary showing an operation of the end detecting unit 106. FIG. 3A shows an operation of the end detecting unit 106 in case of a current continuous mode. In this case, since the output controlling switch 312 is turned on while the secondary coil 404 outputs electric power, the normal signal $V_2$ of the control signal rises up while the output $V_1$ of the Schmidt trigger inverter 710 is L. Therefore, the flip-flops 712 and 714 output the L signal as the Q outputs V4 and V5.

FIG. 3B shows an operation of the end detecting unit 106 in case of a current discontinuous mode. In this case, since the output controlling switch 312 is turned on after the secondary coil 404 ends the output of electric power, the normal signal $V_2$ of the control signal rises up after the output $V_1$ of the Schmidt trigger inverter 710 is inverted into H. Therefore, the flip-flop 712 outputs a pulse signal in response to rising of the output $V_1$ as the Q output $V_4$. Then, the flip-flop 714 outputs the H signal in response to rising of the normal signal $V_2$ based on this pulse signal.

FIG. 3C shows an operation of the end detecting unit 106 when resonance is generated in the output terminal of the secondary coil 404 in a current discontinuous mode. When resonance is generated in the output terminal of the secondary coil 404, the output $V_1$ of the Schmidt trigger inverter 710 resonates in accordance with this resonance. However, the Q output $V_4$ of the flip-flop 712 is cleared in the timing when the output controlling switch 312 is turned on. For that purpose, after the flip-flop 714 latches the D input in synchronization with the timing when the output controlling switch 312 is turned on, the flip-flop 714 holds the value of the Q output $V_5$ while the output controlling switch 312 is turned from off to on. In this case, although resonance is generated in a current or a voltage of the output terminal of the secondary coil 404, e.g., after the secondary coil 404 ends the output of electric power, the resonance can adequately be distinguished from voltage fluctuation by an operation of the secondary coil 404. Therefore, according to this example, an operation mode of the switching regulator 102 can be detected adequately.

Figure 4:
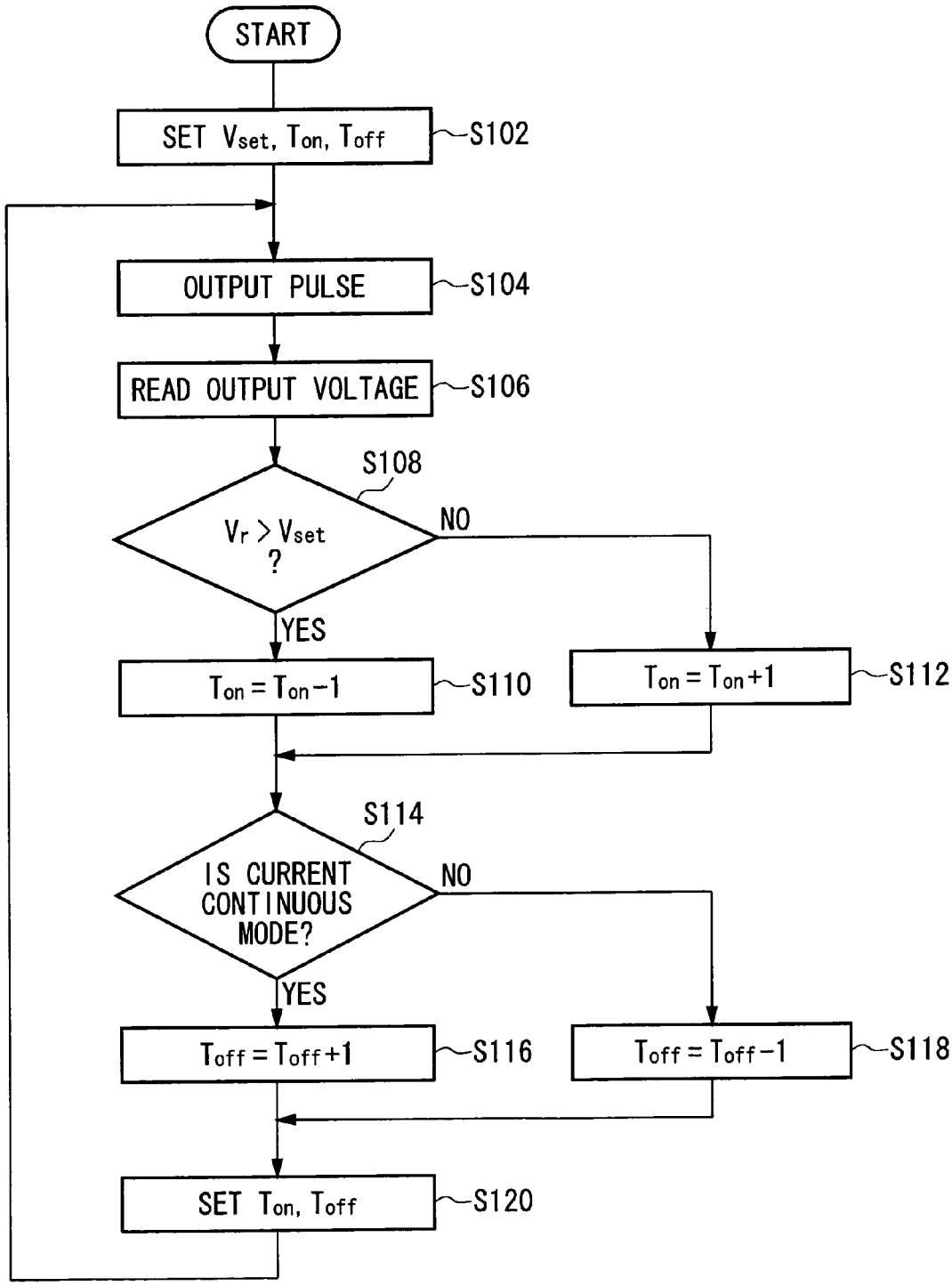
FIG. 4 is a flowchart exemplary showing an operation of a vehicular lamp.

FIG. 4 is a flowchart exemplary showing an operation of the vehicular lamp 10. In this example, the switch controlling unit 410 first sets the default value of a target voltage $V_{set}$ as opposed to the output voltage of the secondary coil 404, and ON time $T_{on}$ and OFF time $T_{off}$ in the control signal (S102). In this case, the default value of the OFF time $T_{off}$ is memorized in the time memorizing unit 412.

Then, the switch controlling unit 410 outputs a pulse of the control signal based on the set ON time $T_{on}$ and OFF time $T_{off}$ (S104), and reads an output voltage $V_r$ output from the power source unit 100 or the switching regulator 102 (S106).

Here, when the output voltage $V_r$ is higher than the target voltage $V_{set}$ (S108: Yes), the switch controlling unit 410 decreases the ON time $T_{on}$ by decrementing numerical value corresponding to the ON time $T_{on}$ by one (S110). In this way, energy accumulated in the secondary coil 404 is decreased according to a pulse of the control signal, and thus the output voltage of the secondary coil 404 is decreased.

In addition, when the output voltage $V_r$ is lower than the target voltage $V_{set}$ (S108: No), the switch controlling unit 410 increases the ON time $T_{on}$ by incrementing numerical value corresponding to the ON time $T_{on}$ by one (S112). In this way, energy accumulated in the secondary coil 404 is increased according to a pulse of the control signal, and thus the output voltage of the secondary coil 404 is increased. For that purpose, according to this example, the output voltage of the switching regulator 102 can adequately be controlled in accordance with the target voltage $V_{set}$.

Next, the end detecting unit 106 detects whether an operation of the switching regulator 102 is a current continuous mode (S114). When it is a current continuous mode (S114: Yes), the time changing unit 414 increments the numerical value corresponding to the OFF time $T_{off}$ in the time memorizing unit 412 by one (S116). In this way, the time changing unit 414 increases the OFF time $T_{off}$ to delay the timing when the output controlling switch 312 is turned on. In addition, the time changing unit 414 brings an operation of the switching regulator 102 close to a current boundary mode.

In addition, when an operation of the switching regulator 102 is not a current continuous mode (S114: No), the time changing unit 414 decrements the numerical value corresponding to the OFF time $T_{off}$ by one (S118). In this way, the time changing unit 414 decreases the OFF time $T_{off}$ to hasten the timing when the output controlling switch 312 is turned on. In this case, the time changing unit 414 also brings an operation of the switching regulator 102 close to a current boundary mode. For that purpose, according to this example, the switching regulator 102 can adequately be operated in a current boundary mode.

Then, the switch controlling unit 410 sets new ON time $T_{on}$ and OFF time $T_{off}$ changed (S120), and then returns to the S104 to output a pulse of the next control signal (S104). According to this example, the switching regulator 102 can be controlled adequately.

In addition, in the S110 or S112, the switch controlling unit 410 may change the ON time T by a predetermined value aside from one. Further, in the S116 or S118, the time changing unit 414 may change the OFF time $T_{off}$ by a predetermined value aside from one. For example, when the end detecting unit 106 is not detecting the end of output in the timing when the output controlling switch 312 is turned on, the time changing unit 414 may change the numerical value stored on the time memorizing unit 412 by the first predetermined modification value. In addition, when the end detecting unit 106 is detecting the end of output in the timing when the output controlling switch 312 is turned on, the time changing unit 414 may change the numerical value stored on the time memorizing unit 412 by the second predetermined modification value in the opposite direction from what is not detecting the end of the output.

Figure 5:
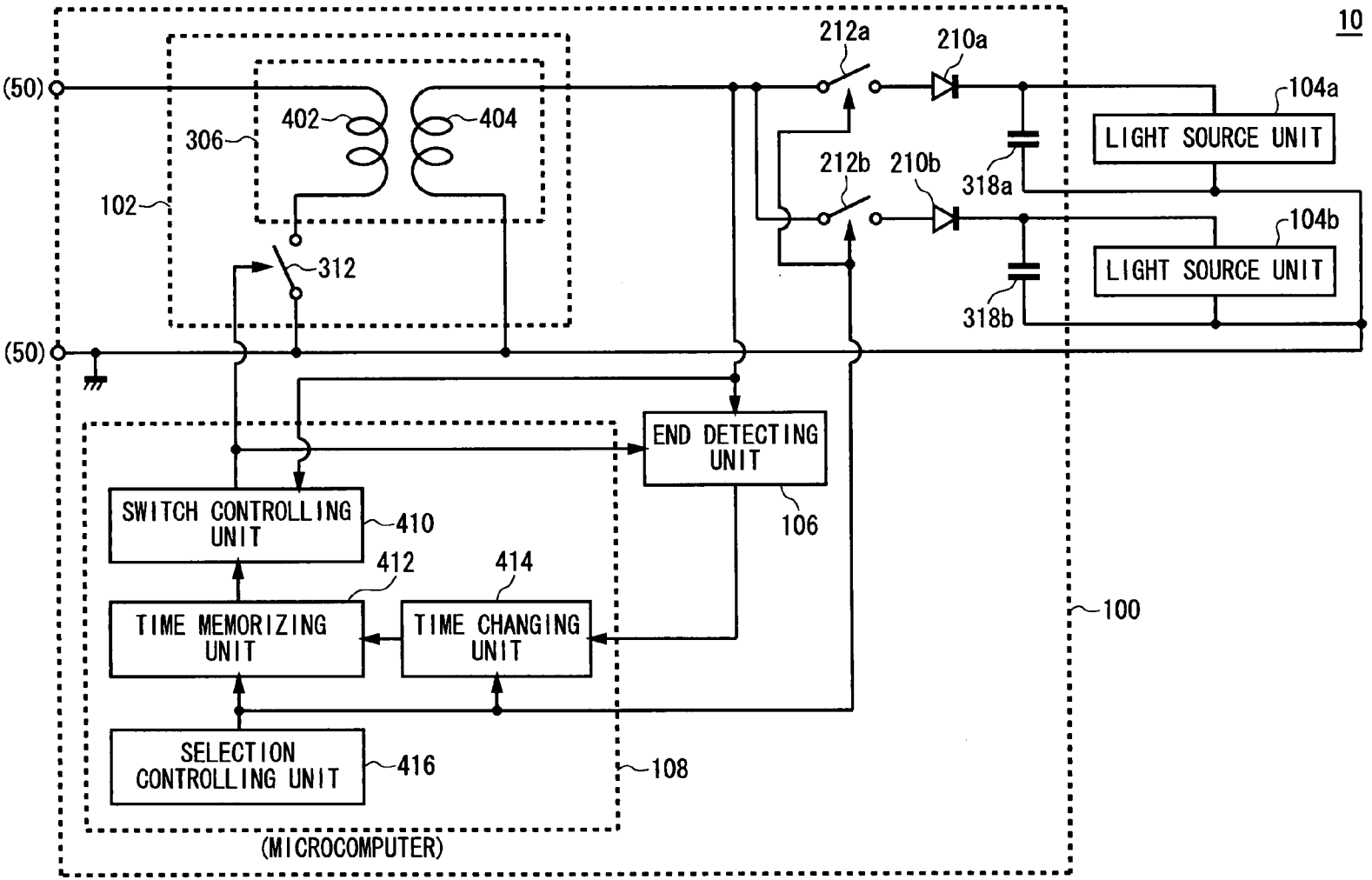
FIG. 5 is a diagram showing another example of a configuration of a vehicular lamp.

FIG. 5 is a diagram showing another example of a configuration of a vehicular lamp 10. In addition, the explanation of the configuration of FIG. 5 having the same reference number as FIG. 1 will be omitted except the components that are below explained because the configuration of the same reference number has the same or similar function. In this example, the vehicular lamp 10 includes a plurality of light source units 104*a* and 104*b* connected in parallel. The light source units 104 are an example of a load connected to a power source unit 100.

The power source unit 100 includes a plurality of diodes 210*a* and 210*b* and a plurality of condensers 318*a* and 318*b* in correspondence with the plurality of light source units 104*a* and 104*b*. In addition, the power source unit 100 further includes light source side switches 212*a* and 212*b* corresponding to the plurality of light source units 104*a* and 104*b*. The light source side switches 212 connect a switching regulator 102 to the corresponding light source unit 104 when being turned on.

An output controlling unit 108 further includes a selection controlling unit 416. The selection controlling unit 416 sequentially selects each of the plurality of light source units 104*a* and 104*b*, and turns on the light source side switch 212 corresponding to the selected light source unit 104. In this example, a time changing unit 414 sequentially selects the subsequent light source unit 104 whenever an output controlling switch 312 is turned off in synchronization with an operation of the output controlling switch 312. In this case, a secondary coil 404 supplies electric power to the light source unit 104 selected by the selection controlling unit 416. In this way, the power source unit 100 sequentially supplies electric power to each of the plurality of light source units 104*a* and 104*b*.

Here, in this example, a time memorizing unit 412 memorizes a plurality of OFF time that is respectively corresponding to each of the plurality of light source units 104*a* and 104*b*. A switch controlling unit 410 switches the output controlling switch 312 on and off based on the OFF time corresponding to the light source unit 104 selected by the selection controlling unit 416. In this case, the time changing unit 414 also changes the OFF time corresponding to the light source unit 104 selected by the selection controlling unit 416 based on the output of the end detecting unit 106. For that purpose, according to this example, although electric power is sequentially supplied to the plurality of light source units 104*a* and 104*b*, the switching regulator 102 can be controlled adequately. In addition, in this example, a switch controlling unit 410 computes ON time for which the output controlling switch 312 should be kept on based on the output voltage of the secondary coil 404.

Although the present invention has been described by way of an exemplary embodiment, it should be understood that those skilled in the art might make many changes and substitutions without departing from the spirit and the scope of the present invention. It is obvious from the definition of the appended claims that embodiments with such modifications also belong to the scope of the present invention.

What is claimed is:

1. A power source apparatus comprising:

an output controlling switch operable to intermittently carry an electric current by repeating on and off;

an output coil operable to accumulate energy according to the current flowing into said output controlling switch when said output controlling switch is turned on and to output an electric power based on the accumulated energy when said output controlling switch is turned off;

an end detecting unit operable to detect that said output coil ends the output of the power; and an output controlling unit operable to switch said output controlling switch on and off, wherein said output controlling unit comprises:

a time memorizing unit that memorizes OFF time for which said output controlling switch should be kept off;

a switch controlling unit that switches said output controlling switch on and off based on the OFF time memorized in said time memorizing unit; and a time changing unit that changes the OFF time memorized in said time memorizing unit, wherein said time changing unit increases the OFF time when said end detecting unit is not detecting the end of the output and decreases the OFF time when said end detecting unit is detecting the end of the output, in the timing when said output controlling switch is turned on.

2. The power source apparatus as claimed in claim 1, wherein said power source apparatus sequentially supplies electric power to each of a plurality of loads connected in parallel, said time memorizing unit memorizes the plurality of OFF time in association with each of the plurality of loads, said output controlling unit further comprises a selection controlling unit that sequentially selects each of the plurality of loads, said switch controlling unit switches said output controlling switch on and off based on the OFF time corresponding to the load selected by said selection controlling unit, said output coil supplies electric power to the load selected by said selection controlling unit, and said time changing unit changes the OFF time corresponding to the load selected by said selection controlling unit.

3. The power source apparatus as claimed in claim 1, wherein said time memorizing unit is a counter that memorizes numerical value corresponding to the OFF time, said time changing unit changes the numerical value memorized in said time memorizing unit by a predetermined first modification value when said end detecting unit is not detecting the end of the output in the timing when said output controlling switch is turned on, and said time changing unit changes the numerical value memorized in said time memorizing unit by a predetermined second modification value in the opposite direction from what is not detecting the end of the output when said end detecting unit is detecting the end of the output in the timing when said output controlling switch is turned on.

4. A vehicular lamp used for a vehicle, comprising:

a light source unit emitting light; and a power source unit supplying electric power to said light source unit, wherein said power source unit comprises:

an output controlling switch that intermittently carries an electric current by repeating on and off;

an output coil that accumulates energy according to the current flowing into said output controlling switch when said output controlling switch is turned on and outputs an electric power based on the accumulated energy when said output controlling switch is turned off;

an end detecting unit that detects that said output coil ends the output of the power; and an output controlling unit that is made up of a microcomputer in at least a part thereof and switches said output controlling switch on and off, and said output controlling unit comprises:

a time memorizing unit that memorizes OFF time for which said output controlling switch should be kept off;

a switch controlling unit that switches said output controlling switch on and off based on the OFF time memorized in said time memorizing unit; and a time changing unit that changes the OFF time memorized in said time memorizing unit, wherein said time changing unit increases the OFF time when said end detecting unit is not detecting the end of the output and decreases the OFF time when said end detecting unit is detecting the end of the output, in the timing when said output controlling switch is turned on.

* * * * *